United States Patent [19]

Parssinen et al.

[11] 4,219,889

[45] Aug. 26, 1980

[54] DOUBLE MASS-LOADED HIGH POWER PIEZO-ELECTRIC UNDERWATER TRANSDUCER

[75] Inventors: Edwin J. Parssinen, Mystic; John F. White; Sidney Baron, both of New London, all of Conn.

[73] Assignee: The United States of America as represented by the Secretary of the Navy, Washington, D.C.

[21] Appl. No.: 56,611

[22] Filed: Sep. 16, 1960

[51] Int. Cl.[3] ..... H04R 17/00

[52] U.S. Cl. ..... 367/158

[58] Field of Search ..... 340/9, 10, 11, 8, 8 MM; 367/157, 158

[56] References Cited

U.S. PATENT DOCUMENTS

| | | | |
|---|---|---|---|
| 1,678,116 | 7/1928 | Harrison | 340/8 MM |
| 2,380,931 | 8/1945 | Batchelder | 340/9 |
| 2,434,255 | 1/1948 | Bond et al. | 340/8 MM |
| 2,560,066 | 7/1951 | Batchelder | 340/8 |
| 2,908,245 | 10/1959 | Camp | 340/11 |
| 2,922,483 | 1/1960 | Harris | 340/8 MM |
| 2,930,912 | 3/1960 | Miller | 340/10 X |
| 2,947,888 | 8/1960 | Harris | 340/11 |
| 2,947,889 | 8/1960 | Rich | 340/11 X |
| 2,961,637 | 11/1960 | Camp | 340/10 |
| 3,068,446 | 12/1962 | Ehrlich et al. | 340/8 |

OTHER PUBLICATIONS

NRL Report 5267, by S. Hanish, pp. ii, 1 & 2, Mar. 6, 1959.

Military Spec. Comm. Set, Sonar, Swimmer's, 21 pp. Mil-C-17831A (Ships) Feb. 16, 1956.

*Primary Examiner*—Richard A. Farley

*Attorney, Agent, or Firm*—Richard S. Sciascia; Arthur A. McGill; Prithvi C. Lall

EXEMPLARY CLAIM

1. An improved underwater transducer comprising a piston of titanium having a planar active face for transfer of sonic wave energy between said piston and the water to which it is exposed, a housing having an opening whose perimeter is slightly larger all around than the perimeter of the piston, said piston being disposed across said opening, and nearly closing said opening with its active face directed outwardly, an elastomeric sealing material bonded to the perimeter of the piston and the perimeter of the housing around the opening and together with the piston completely closing the opening in the housing and with the active face of the piston exposed for contact with sea water, said elastomeric material permitting vibratory reciprocation of said piston relative to said housing and normal to its planar face for transfer of sonic energy between the piston and the water to which it is exposed, an electromechanical energy conversion means supported in the housing and coupled to the piston, said means together with said piston comprise a double mass elastic system and includes an electromechanical transducer element to which is securely and rigidly affixed said piston and another mass with the transducer element therebetween with the piston, the other mass and the transducer element in line and oriented longitudinally of the housing, and an acoustic isolator pressure release material in the form of a stack of paper disposed between the inner end of said other mass and the housing in the direction of relative longitudinal movement therebetween.

10 Claims, 14 Drawing Figures

DOUBLE MASS-LOADED HIGH POWER PIEZO-ELECTRIC UNDERWATER TRANSDUCER

The invention described herein may be manufactured and used by or for the Government of the United States of America for governmental purposes without the payment of any royalties thereon or therefor.

This invention relates to underwater electroacoustic transducers and more particularly for use under demanding conditions and for use in an underwater transducer array having on the order of a thousand transducer units.

Waterborne vessels now range deeper than ever before and from the trend of present developments it is evident that the floor beneath the earth's waters will be the depth limit of forthcoming vessels. "Eyes", "ears" and "communication voices" are needed for such vessels. Sonar and acoustic communication equipments to date, afford the only means of satisfying these needs. Prior transducers for sonar equipments have comparatively limited tolerance to pressure change and cannot withstand higher hydrostatic pressures. Also, in terms of present day requirements they have limited echo ranging capability, on the order of a few thousand yards, comparatively poor resolution and accuracy, are too delicate for continuous duty in high speed maneuvers over wide depth and temperature ranges for extended periods of months, and lack adequate power capacity and source radiating intensity.

As submarines are continually being designed to attain greater and greater depths, the need for functional, deep submergence sonar systems has rapidly become one of paramount importance. Transducers previously employed in sonar systems have demonstrated that they lose efficiency quite rapidly when they are made to operate at depths greater than heretofore. This loss in efficiency is due to a significant extent to characteristics of pressure release materials used heretofore, which become very lossy as depth is increased; they become stiffer and their internal losses increase as the depth is increased. This stiffening, or loss of compliance also raises the resonant frequency of the transducers, and lowers the mechanical Q considerably, effects which may be particularly undesirable under some operating conditions.

An object of this invention is to provide an improved underwater transducer for use in a transducer array where the transducer is accurately reproducible in quantity, is compact, efficient, and has a comparatively large power radiating capacity per unit weight and per unit volume of the transducer under high hydrostatic pressure.

A further object is to provide an improved underwater transducer operable efficiently both as a hydrophone and as an acoustic transmitter under demanding conditions.

A further object is to provide an improved transducer wherein the radiating face is directly in contact with the sea water to eliminate the problems and losses resulting from a transducer boot and the space occupied by an enveloping boot.

A further object is to provide an improved underwater transducer characterized by good performance stability over a wide temperature range.

A further object is to provide an underwater transducer characterized by fairly stable performance over a pressure range of several thousand pounds per square inch.

A further object is to provide an improved transducer capable of radiating acoustic power at a source intensity on the order of two watts per square centimeter of radiating surface over a wide temperature and pressure range and having a substantially non deformable radiating surface under operating conditions so that the beam of an array of the transducers can be directed accurately.

A further object is to provide a pressure release material whose compliance varies little over a wide range of pressure and whose resonant frequency varies little over a wide pressure range.

A further object is to provide an improved transducer having the characteristics specified in any combination of the preceding objects and that is comparatively simple, practical, inexpensive, easy to fabricate, having high electroacoustical efficiency, good linearity with power drive, capable of manufacture in large numbers with closely matched characteristics, good vibration isolation, high damage resistance to shock and vibration, performing generally better than transducers available heretofore, and capable of use in listening, ranging, and communication applications.

Other objects and many of the attendant advantages of this invention will be readily appreciated as the same becomes better understood by reference to the following detailed description when considered in connection with the accompanying drawings wherein.

Figure 9:
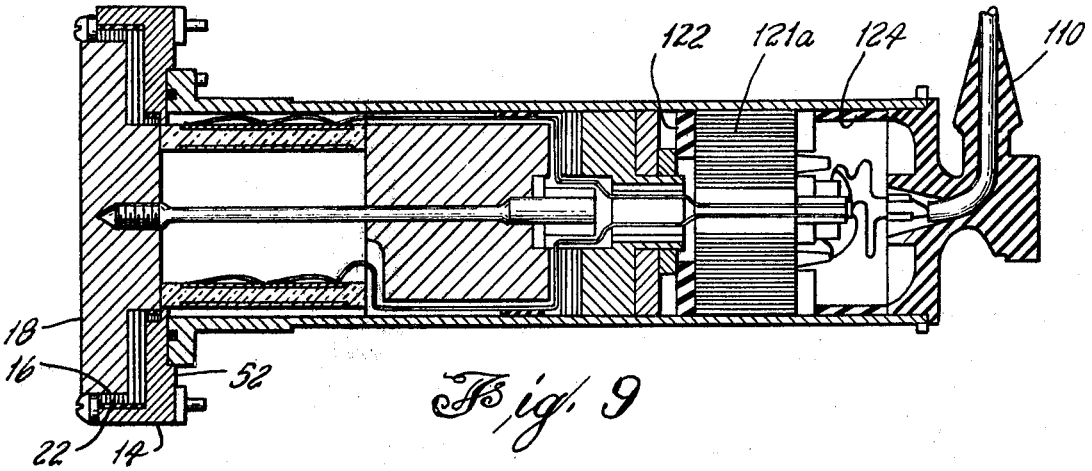
FIG. 9 is a cross section view similar to FIG. 5 including a tuning coil for the active element.
Figure 1:
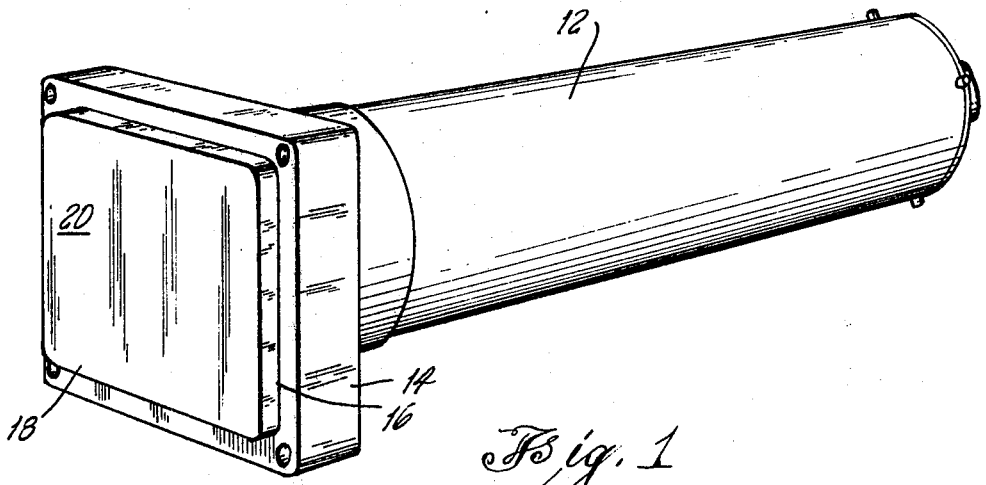
FIG. 1 is a view in perspective of an assembled transducer in accordance with this invention showing in particular the compactness of the transducer, the radiating surface intended for direct contact with seawater and the configuration which enables a number of such transducers to be assembled into an array with a minimum ratio of inactive area to active area.
Figure 2:
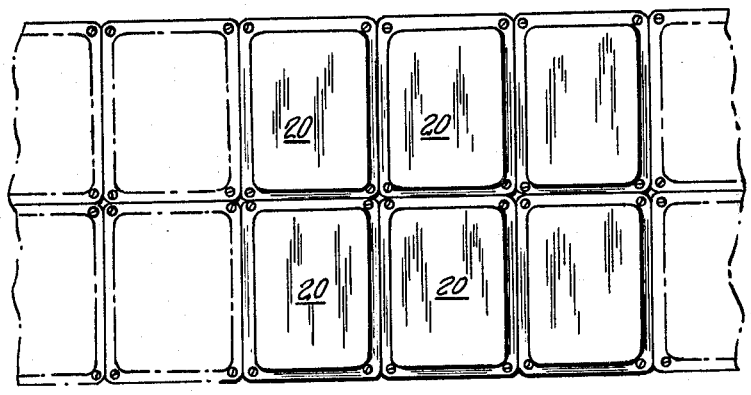
FIG. 2 is a front face view of an array of said transducers.
Figure 5:
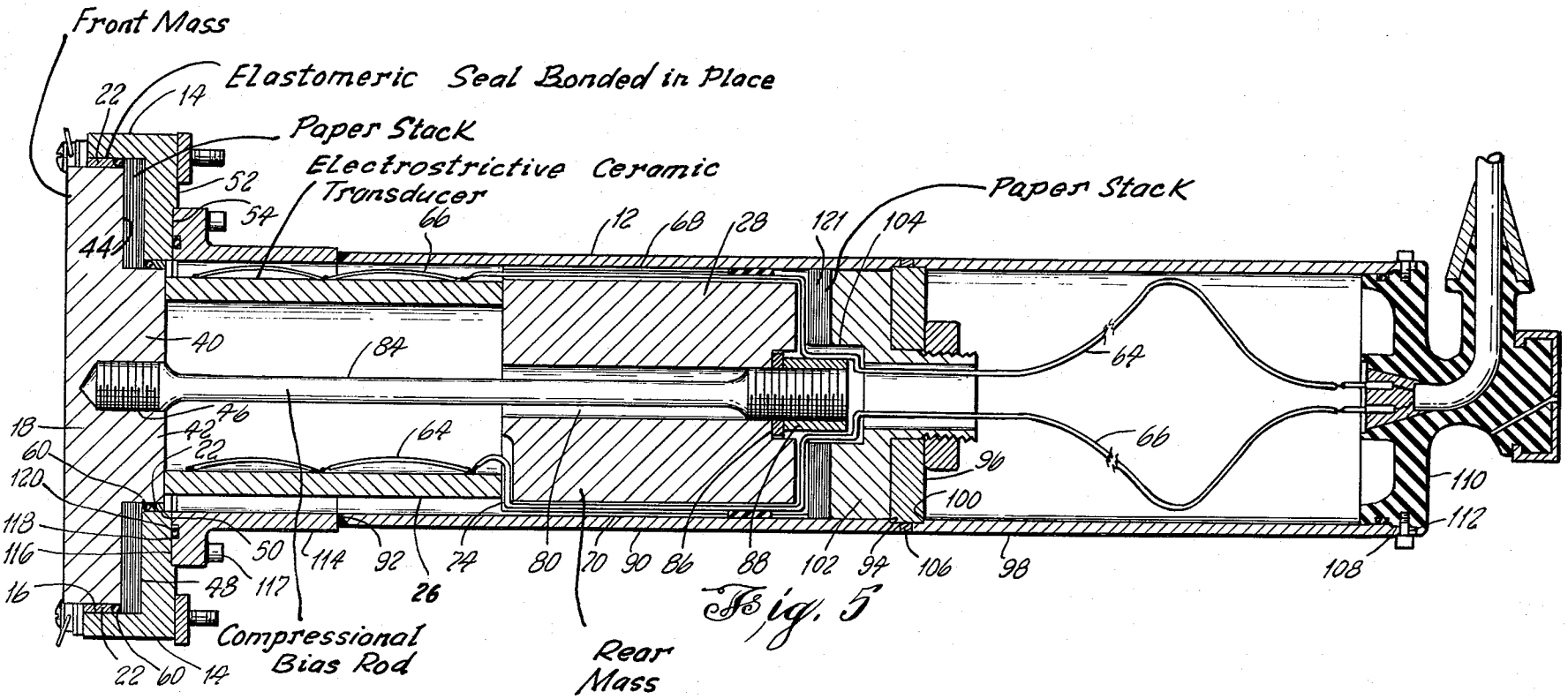
FIG. 5 shows in cross section an embodiment of this invention incorporating the features in FIGS. 1–4.

The transducer embodiment shown in perspective in FIG. 1 includes an elongated cylindrical housing 12 that terminates at one end in an enlarged rectangular section 14 coaxial therewith and having an end-wise opening 16 almost as large in transverse dimensions as the section 14. The housing is of a material e.g., stainless steel, that is non-corrosive in sea water. A metallic piston-like mass 18, having a planar face 20, a substantially rectangular perimeter which is slightly smaller all around than similar-shaped inside perimeter of the section 14 surrounding opening 16. The piston 18 is recessed into, and supported across the opening 16 with its planar face 20 exposed outwardly for contact with sea water and nearly closes the opening 16. An elastomeric sea water impervious material 22, e.g., neoprene, shown in FIGS. 5 and 9, is bonded to the perimeter of the piston and the inner perimeter of the housing section 14 around the opening 16 and together with the piston 18 completely closes and hermetically seals the opening 16 in the housing. The piston 18 is reciprocable relative to the housing in directions normal to its planar face for radiating acoustic power into sea water in contact therewith and responsive to intercepted acoustic energy in the sea water. Most and preferably substantially all of the piston material is of the element titanium. In other words, the piston preferably is of substantially pure titanium. Titanium has a combination of properties which render it especially advantageous for the piston 18. First it has a comparatively high ratio of sound velocity to density and comparatively high flexural stiffness whereby the piston may be designed so that the frequencies of flexural resonance are well above the lower audio range, namely well above 3.5 kilocycles without having a high ratio of thickness to transverse dimensions. Therefore, if the transducer is operated as an acoustic transmitter in the lower audio range, flexural resonances in the piston 18 present no difficulty. Second, titanium is a lightweight material. Third, titanium has excellent corrosion resistance to sea water even when reciprocated at an audio frequency rate on the order of several thousand cycles per second and at an amplitude to radiate acoustic power on the order of two watts per square centimeter of the piston face. This anti-corrosion characteristic obviates the need for a rubber boot with its inherent acoustical losses and constructional problems. In the housing there may be included conventional means, not shown, in FIG. 1, for reciprocably driving the piston and/or for detecting acoustic energy intercepted by the piston. The means may include electrostrictive, magnetostrictive, electromagnetic or other devices. Regardless of the nature of the energy conversion means within, the titanium piston radiator hermetically sealed to the housing is superior to comparable acoustic piston radiator elements used heretofore in this type of combination. Another advantage of the construction shown in FIG. 1 is illustrated by FIG. 2. A plurality of the transducers may be assembled into an array with the piston faces 20 close together and with a small ratio of inactive area to active area. Elimination of the need for rubber boots by use of titanium pistons 20 also enables the transducers to be brought closer together. Rubber boots increase the overall transverse dimensions.

Figure 3:
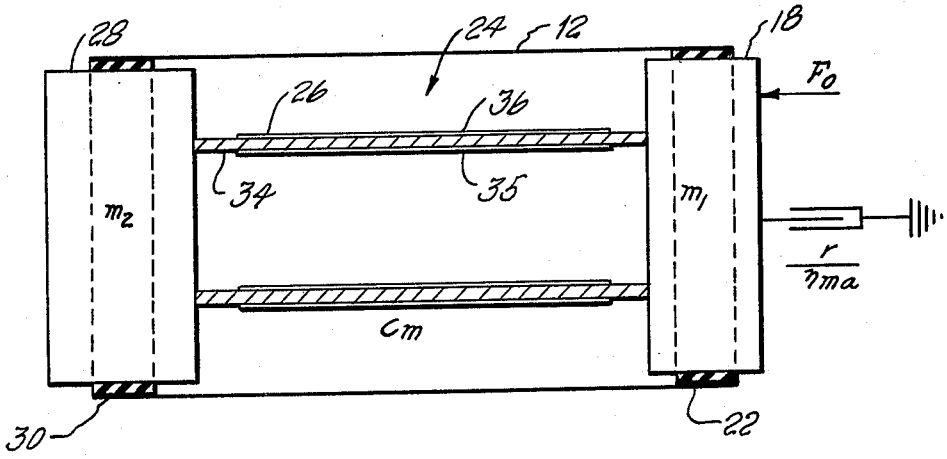
FIG. 3 is a mechanical schematic of an electromechanical energy conversion means in the form of a double mass elastic system for the transducer of FIG. 1.

In the mechanical schematic in FIG. 3, there is shown an electromechanical energy conversion means for use in the assembly of FIG. 1. It comprises a double mass elastic system 24 for driving the piston 18 and/or for detecting acoustic energy intercepted by the piston. The double mass elastic system includes an electromechanical energy conversion element 26, piston 18 secured and rigidly affixed to one end thereof and a mass 28, substantially heavier than piston 18 secured and rigidly affixed to the other end of the element 26. Elastomeric strips 22 and 30 support the system 24 in tubular housing 12. With air otherwise surrounding the system 24 in the housing, the system is effectively acoustically isolated from the housing. At shallow depths where the pressure is low this acoustic isolation arrangement is adequate and gives satisfactory results. Through the use of a double mass elastic system efficient transducer action is obtained, vibrations are isolated from the housing 12, and the several transducers shown in FIG. 2, though contiguous, are acoustically well isolated from each other.

Figure 4:
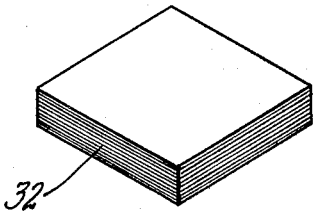
FIG. 4 shows an improved pressure release material for a transducer.

While the transducer shown in FIG. 3 is satisfactory for use under low static pressure conditions, it cannot be used under high static pressure conditions, hundreds of pounds and up per square centimeter of piston radiating surface corresponding to deep water. The mass elastic system would be forced back into the housing and even if the air behind the mass 28 were trapped and compressed, very highly compressed air is too stiff for an acoustic pressure release material. Furthermore, the volume of a gas is inversely proportional to the pressure of the gas. If air is used as a pressure release material where pressure changes by a factor of 100, the transducer would have to be designed for considerable axial displacement of the mass elastic system in the housing as a function of static pressure. This is impractical. In FIG. 4, there is shown an acoustic isolator pressure release material 32 that yields excellent results at extreme static pressures, results that are much superior to those provided by pressure release materials used heretofore. The material 32 comprises laminae of fibrous material; e.g., sheets of paper, of the type that is on the order of nine pounds per ream, dry, 100% rag, onion skin paper stacked to a thickness on the order of ¼ inch has yielded excellent results. Paper is homogeneous, travels relatively short distances in compression, is inexpensive and abundant. The properties of paper are better over a pressure range if the paper is oven dried before being assembled into the transducer. If a stress-strain curve of the paper stack is plotted for pressure cycles, some hysteresis is evidenced. However, if the paper is subjected to pre-stress pressure of approximately 1000 pounds per square inch for an hour before using and kept under a compressive force no less than about fifty pounds per square inch, after assembly, the hysteresis effect is comparatively negligible. Fibrous laminar material, particularly the paper specified has the properties of high compliance, low losses, substantially no permanent set, and negligible volume change over a very wide range of pressure. This type of material for acoustic pressure release is superior in this type of combination even at pressures near atmospheric.

In a perfect pressure release material the reflection coefficient is zero db and the relative phase is 180° over the whole pressure range. A stack of paper as described approaches these ideals more closely than prior pressure release materials.

High overall electroacoustic efficiency is of primary concern in transducers, and the characteristics of the pressure release has a substantial effect on this efficiency. The electroacoustic efficiency is equal to the product of electromechanical efficiency and mechanoacoustic efficiency. In transducer design the electromechanical efficiency is mostly determined by the type of active transducer material used. It is not greatly affected by mounting methods or pressure release materials. However, the mechanoacoustic efficiency is quite dependent upon pressure release materials. The use of paper stacks as described above in a transducer results in higher mechanoacoustic efficiency.

The electromechanical transducer element 26 shown in FIG. 3 is an electrostrictive ceramic cylinder. Electrostrictive elements do not require a direct current power supply for polarization as do magnetostrictive transducer elements, and for a given power rating, and bandwidth, may be made smaller and of lighter weight than other types of electromechanical transducer elements, and possess good signal sensitivity.

The electromechanical energy conversion element 26 is FIG. 3 is a hollow, circular, electrostrictive ceramic cylinder 34 having conductor film electrodes 35 and 36 fired on its inner and outer cylindrical surfaces respectively. The electrodes terminate short of both ends of the ceramic cylinder so that the capacitive impedance between the electrodes and the metal masses 18 and 28 is high enough not to provide a low impedance bypass across the electrodes. The cylindrical design has the advantages of high structural rigidity, high compressive strength, resistance to flexure, and light weight; also it lends itself to mass production uniformity and ease of assembly with cooperating elements. The cylinder 34 is polarized radially. Though there is some sacrifice in the piezoelectric coupling coefficient in the longitudinal mode through radial polarization instead of through longitudinal polarization, the cylinder will not be depolarized by compressive end loading. In fact, compression applied normal to the direction of polarization increases the residual polarization. Significant depolarization would occur with high compressive end loading if the cylinder were polarized longitudinally.

Barium titanate is a well-known ceramic material for electrostrictive transducers that may be used in the described combination; reports on barium titanate electrostrictive ceramics are in the ceramic, acoustic, and sonar literature. However, all barium titanate ceramics are low power transducer materials, satisfactory for hydrophones but not applicable to high power acoustic transmitters. Lead titanate lead zirconate solid solution ceramics have a number of properties including high power capacity, high Curie temperature, high electric field strength, low dielectric losses, resistance to polarization loss under fairly severe conditions of temperature and electric field intensity, good temperature stability, high piezoelectric coupling coefficient. PZT-4 is one example of a good lead titanate lead zirconate ceramic having these properties. PZT-4 is a registered trademark of Clevite Electronic Components, a division of the Clevite Corporation of Cleveland, Ohio. PZT-4 and its properties are discussed and set forth in the manufacturer's bulletin 9244 and in a paper entitled "Transducer Properties of Lead Titanate Zirconate Ceramics" by Don Berlincourt, Bernard Jaffee, Hans Jaffee and Helmut H. A. Krueger published in IRE Transactions on Ultrasonic Engineering, Vol. UE-7 February 1960, Number 1.

Figure 6:
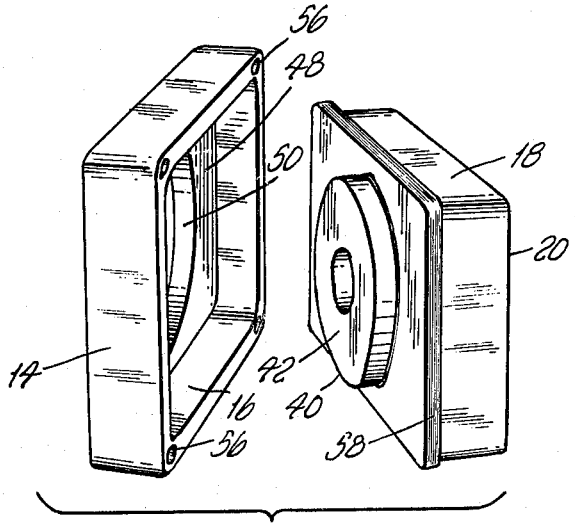
FIG. 6 is an exploded view of the piston and housing portion of the transducer in FIG. 5.

The embodiment of the invention shown in FIG. 5 includes the features described above. The rectangular piston 18 of titanium is symmetrical about an axis therethrough and is formed with a circular boss 40, shown more clearly in FIG. 6, opposite its acoustic radiating face 20; the end face 42 of the boss 40, the surface 44 and the acoustic radiating face 20 are all finished smooth and parallel normal to the axis of the piston. A threaded blind hole 46 is formed axially through the end face 42. The rectangular section 14 of the transducer housing is formed with a rectangular recess 48 and circular hole 50 extending axially through the wall at the bottom of the recess. The length and width of the rectangular recess are somewhat larger than the corresponding dimensions of the piston while the depth of the recess is selected so that when operating under high static pressure, the piston is not completely recessed into the rectangular recess 48. The rectangular rear end face 52 (FIG. 8) of the section 14 is formed with a shallow circular coaxial recess 54, the bottom of which is normal to the axis and whose selected diameter is formed accurately within close tolerance for locating the housing 12 at assembly. The side wall and bottom of the recess 54 are finely finished. A longitudinally extending bolt hole 56 (FIG. 6) is formed through each corner of the section 14. A stack of dry thin rag paper 58, as described above, and on the order of ¼ inch thick, cut out to fit over the boss 40 and to seat snugly in the recess 48, is assembled between the housing section 14 and the piston 18. Then with the piston 18 and rectangular housing section 14 supported in a jig, packing 60 is forced between the housing section 14 and the piston 18 to each side of the paper stack. With the aid of a suitable jig, an elastomer 22 such as neoprene in fluid form is forced over both packings 60, and prevented by the packings from reaching the paper. The fluid neoprene is oven-cured under pressure and bonded to the section 14 and piston 18 to form hermetic seals and mechanical supports for piston 18 corresponding to element 22 in FIGS. 3 and 4. The elastomer serves as a low loss mounting and hermetically seals in the paper.

The end surfaces of the ceramic cylinder 26 are formed smooth and perpendicular to its axis. One end face of the ceramic cylinder 26 is cemented rigidly and thoroughly all around to the end face 42 of the boss 40 and coaxial therewith. An example of a cement useful for this purpose is the commercially marketed "Eastman 910." (The cement used should be rigid after it sets; epoxy cements are suitable.) Then electrical conductor leads 64 and 66 are soldered to the inner and outer surfaces of the cylinder 26.

Figure 7:
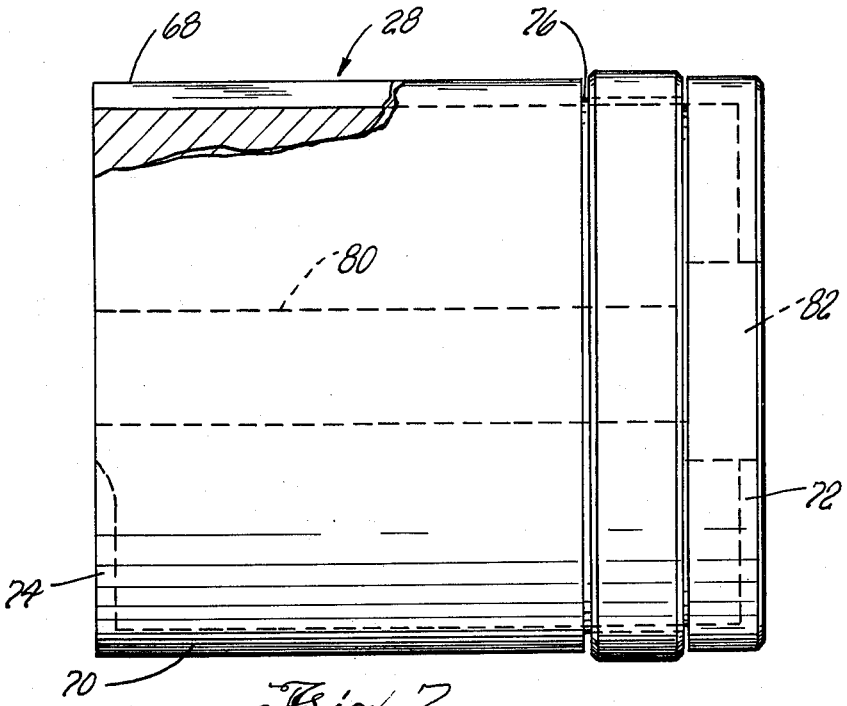
FIG. 7 is a detail plan view of the rear mass included in the embodiment of FIG. 5.

The cylindrical mass 28 (FIG. 7) is substantially symmetrical about an axis therethrough and both its end surfaces are finished smooth and perpendicular to its axis. Brass is a satisfactory material for mass 28 being easy to machine and fairly dense. It is formed with two longitudinally extending, diametrically opposite shallow grooves 68 and 70 in its outer cylindrical surface; two radial grooves 72 extend across one end face and join the grooves 68 and 70 and a radial groove 74 extends part way across the other end face inwardly from the groove 70. A circular shallow groove 76 substantially wider than the grooves 68 and 70 is formed in the outer surface near the end having the groove 72. Two flat strips 78 of an elastomer such as neoprene are cemented in the groove 76 to extend between the longitudinal grooves 68 and 70. An axial bore 80 extends through the mass 28 and at the end having the groove 72 is stepped to a larger diameter 82. With the conductor 66 extending radially outwardly of the cylinder 26 and nested in the groove 74 of the mass 28, the mass 28 is cemented to other end of ceramic cylinder 26 coaxially therewith in like manner as the cylinder 26 and the piston 18 are cemented together. A beryllium copper rod 84 threaded at both ends extends through the mass 28, is screwed tightly into the threaded hole 46 of the piston and with a washer 86 seated in the enlarged end of the bore 80, a nut 88 is tightened on the other end of the rod. The rod must be many times more compliant than the ceramic cylinder. The direction of the threads are chosen so that in tightening the nut 88, the other end of the rod is more tightly threaded into the hole 46 of the piston. Before the rod is put under tension, the electrical leads are connected to sensitive voltage measuring means previously calibrated in terms of compressive loading on the ceramic cylinder 26. Then the nut 88 is tightened further until the rod is under a predetermined amount of tension, sufficient to prevent any tensile stress in and rupture of the adhesive joints at the ends of the ceramic cylinder and the cylinder itself in low acoustic loading during high power acoustic transmission and low acoustic loading; the tension in the rod is high enough so that under minimum radiation loading, and maximum amplitude drive, the adhesive and the ceramic cylinder are at no time under tension. The tension rod 84 may be omitted if not needed for this purpose (e.g., in hydrophones).

The housing 12 is formed of stainless steel; commercial type number 316 stainless steel is a satisfactory material for this purpose. The housing includes an intermediate tubing section 90 whose inside diameter is somewhat larger than the outside diameter of the mass 28; the tubing 90 is beveled at one end 92 preparatory to welding, and at the other end its inside diameter is enlarged to form a seat 94 for circular stainless steel block 96. A second tubing section 98 having the same inside and outside diameters is formed with a corresponding seat 100 for the block 96; the depths of the two seats 94 and 100 are less than the thickness of the block. Because the rod 84 and the nut 88 extend beyond the end of the mass 28, an adaptor 102 with a recess 104 for receiving the end of rod 84 and nut 88 is secured to the block 96. The adapter has a central passage for the electrical conductors 64 and 66. At assembly, with the adaptor 102 secured to block 96, the block 96 is firmly seated in the ends of tubing sections 90 and 98, thereby axially aligning the tubing sections and then the tubing sections are welded together as shown at 106. The other end of the tubing section 98 is formed with a seat 108 for a water-tight cable fitting 110 and is formed with a circular series of screw holes 112 to enable the cable fitting 110 to be secured in place at assembly. The wall thickness of the tubing is selected to withstand anticipated maximum static pressure. To the beveled end 92 of the tubing section 90, there is secured a circular flanged section 114 having a finished end face 116 finely finished normal to its axis and having the same inside diameter as the tubing 90. The perimeter of the flange is finished for a close locating fit in the recess 54 of the housing section 14. The flange is formed with a series of longitudinally directed holes for fastening screws 117 and a circular recess 118 in the end face of the flange for seating a conventional water seal packing 120. The flange section 114 and the tubing section 90 are welded together in axial alignment.

Figure 8:
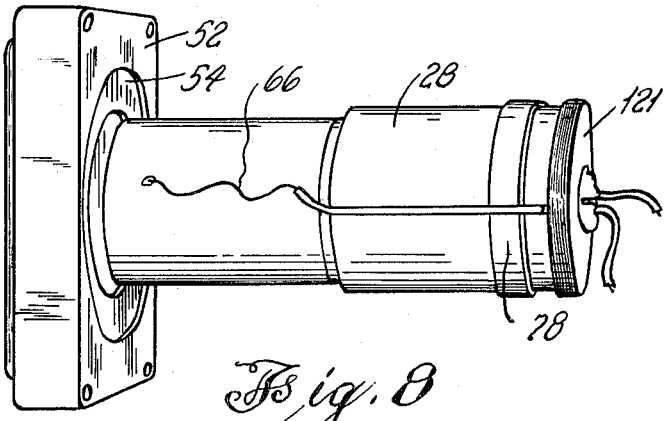
FIG. 8 is a subassembly of the transducer of FIG. 5, in perspective.

The conductors 64 and 66 are seated in the grooves 68 and 70 and the radial grooves 72 and disposed alongside the nut 88. Acoustic pressure release material 121 similar to paper stack 32 or 58, cut to fit over the nut 88 and to fit snugly inside the tubular housing section 90, is assembled over the nut 86. This subassembly is shown in FIG. 8. Then the conductors 64, 66 are threaded through the adaptor 102 and the housing 12 is slid down over the assembly shown in FIG. 8 with the packing 120 in place in the groove 118 of the flanged section 114. The end face of the flanged end of the housing 12 is nested into the circular recess 54 of the rectangular section 14, and screws and lockwashers 117 complete the assembly.

A tuning coil 121*a* is connected in circuit with the ceramic cylinder to resonate with the capacity of the ceramic cylinder. The coil may be supported away from the transducer housing or inside the housing section 98 as shown in FIG. 9 where it is disposed in, and fits snugly in section 98 of the housing, between adaptor spacers 122 and 124. The transducer conductors are brought out of the transducer through water tight fitting 110 secured and sealed water tight to the end of the housing section 98.

The piston 18 may be made circular. However, in an array, the rectangular configuration is advantageous in that there is less inactive area between adjacent radiating piston faces. If the transducer will not be operated at high power or where it will be used solely as a hydrophone, the rod 84 may be omitted. If excellent adhesive joints are provided at the ends of the ceramic cylinders, the rod may be eliminated if the driving power is properly limited. If the ceramic is one that has a high Curie temperature, such as 600° F. of PZT-4, it is possible to use high temperature (300° F.) curing epoxy resins, that are strong and rigid when cured. A method of obtaining good adhesive joints with these resins in first to clean the ceramic ultrasonically to remove all loose ceramic powder debris and then to apply the adhesive, join the elements to be adhered, elevate the temperature till the adhesive is in its most fluid state, vibrationally displace the elements being joined by the adhesive while the adhesive is in a very fluid state whereby gas bubbles are driven out of the adhesives and better surface wetting by the adhesive is achieved. This method is described in greater detail in U.S. application Ser. No. 20,505 filed Apr. 6, 1960, by David E. Parker for Improving Adhesive Joints By Vibration and assigned to the U.S. Government. However, because the ceramic and the resin has a lower coefficient of expansion than the metal masses, it is advantageous to interpose a material such as Invar disks between the ends of the ceramic cylinder and the masses. Because the Invar to end-mass bonds has a larger cross section than the Invar to ceramic bonds, the use of room temperature curing adhesive of lower strength is suitable for the Invar to end mass bonds because the peak stress there is lower. The rod is necessary if it is to be expected that the transducer may be accidentally overdriven either by application of overvoltage or as a result of low acoustic loading, whereby the adhesive joints might rupture or the ceramic might fracture because of excessive stress in tension. Where the stressed metal rod is used, the Invar disks are unnecessary. The stressed metal rod applies a compressional bias to the adhesive bonds and the ceramic and thus reduces the peak stresses in tension. These lowered peak stresses permit the use of lower-strength, room temperature curing cements. It is advantageous to use the rod to apply sufficient mechanical bias or tension whereby under anticipated usage, the adhesive bonds are always under compression, never under tension. Beryllium copper is suitable for the rod because of its high compliance compared to the ceramic cylinder, its high yield strength, and its low creep.

Design Considerations

The relationship of approximate maximum mechanical power output with some parameters of the described transducer is obtainable from the following equation:

$$Pm=\omega r k^2 Qm \epsilon^F E^2 V$$

where

Pm=approximate maximum mechanical output power in watts at resonance $\omega r$=radial resonant frequency of the ceramic cylinder in radians per second k=effective electromechanical coupling coefficient in the mode of operation Qm=mechanical storage factor $\epsilon^F$=free permittivity, farads per meter $\epsilon_o$=K where K is dielectric constant and $\epsilon_o$=permittivity of free space=$8.85\times10^{-12}$ E=maximum allowable field strength in volts rms per meter for the selected pulselength and duty cycle V=volume of active material in meters$^3$ The frequency ($\omega$) is dictated by performance requirements. The factors k, E and $\epsilon^F$ are functions of the selected electrostrictive material and can be determined by conventional measurement techniques on the selected material; generally this information is obtainable from the commercial supplier of the material. It is desirable to choose a material wherein these factors are as high as possible, subject to other limitations of the material. The Qm is selected by the designer to satisfy operating requirements, for example, bandwidth. The equation is used to solve for the volume (V) of material to satisfy a selected power requirement (Pm). However, the volume (V) of active material is generally limited by practical considerations such as maximum allowable weight and the size and shape of the ceramic. Compromises may have to be made. The total mass required to resonate the compliance (reciprocal of stiffness) of the cylindrical active element is obtained as follows:

$$m\ \text{total} = \frac{1}{\omega^2} Cm$$

where m total is the total of the two masses at the ends of the cylindrical active element and Cm is the compliance of the element. The compliance Cm of a cylinder is defined as:

$$Cm = \frac{l}{AY}$$

where l=length of cylinder

A=cross sectional area of the cylinder wall

Y=Young's modulus for the material

Figure 10:
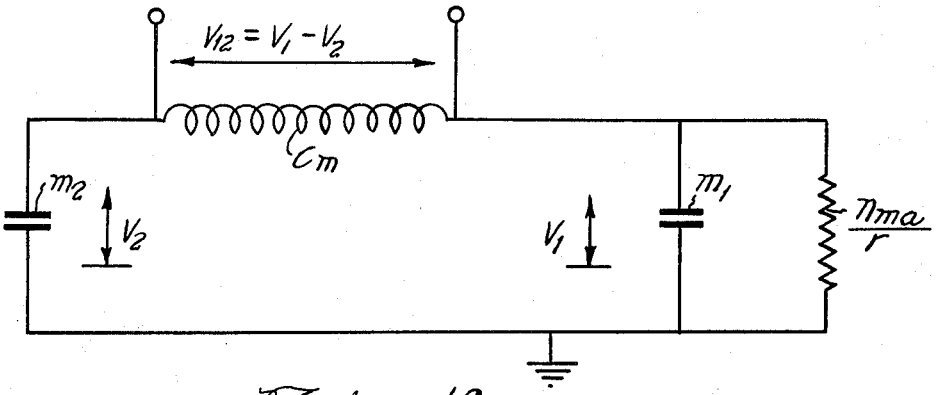
FIGS. 10 and 11 are equivalent electrical circuits for a double mass elastic system radiating from one end and having corresponding reference characters.
Figure 11:
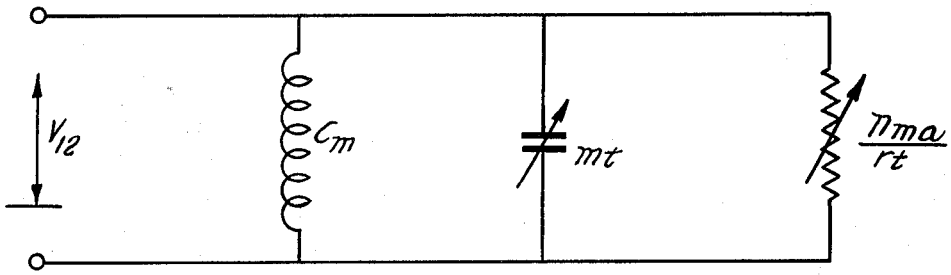

An equivalent circuit for a double mass elastic system as in FIG. 3 radiating acoustic power from one end is shown in FIG. 10. The radiation resistance r into which the acoustic power is radiated is shown symbolically in FIG. 3 as a grounded dashpot. FIG. 11 is the same equivalent circuit but in parallel form. The relationship of the two masses is obtainable from these equivalent circuits as follows:

$$mt = \frac{m_1 m_2}{m_1 + m_2}\left[1 + \frac{m_1/m_2}{1 + \frac{(\eta_{ma}\omega r(m_1+m_2))^2}{r}}\right]$$

Figure 12:
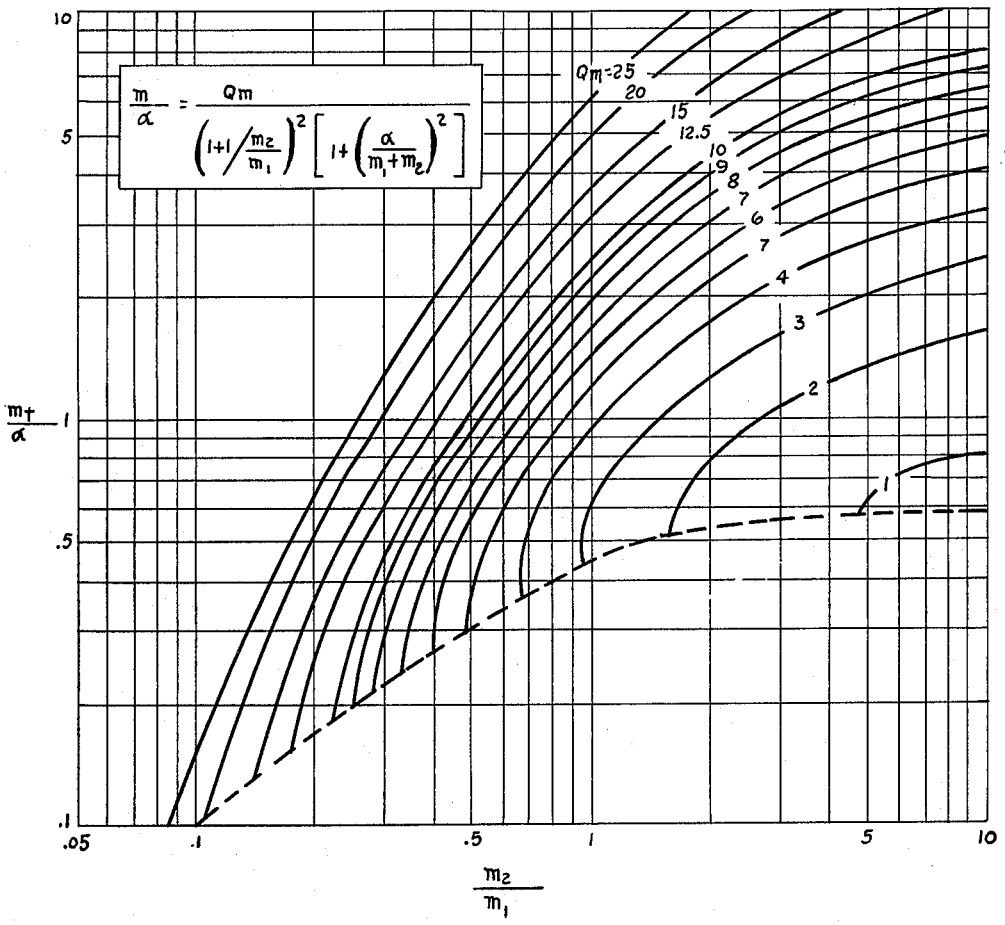
FIG. 12 is a family of curves for use in designing a transducer of the type disclosed.

In FIG. 12 there is plotted $$\frac{mt}{\alpha}$$

against $$\frac{m_2}{m_1}$$

with Qm as a parameter where $$\eta_{ma} = \text{mechanoacoustical efficiency} = \frac{\text{radiation resistance } (r)}{\text{internal loss resistance } (R_M) + r}$$

$r$ = radiation resistance $$\alpha = \frac{r}{\eta_{ma}\omega r}$$

$$\frac{mt}{a} = \frac{Q_m}{\left(1 + 1/\frac{m_2}{m_1}\right)^2\left[1 + \left(\frac{\alpha}{m_1+m_2}\right)^2\right]}$$

Total mechanical power radiated is equal to $(\nu_{12}^2)$ (r) where $\nu$ is velocity and $\nu_{12}$ is $\nu_1-\nu_2$.

Figure 13:
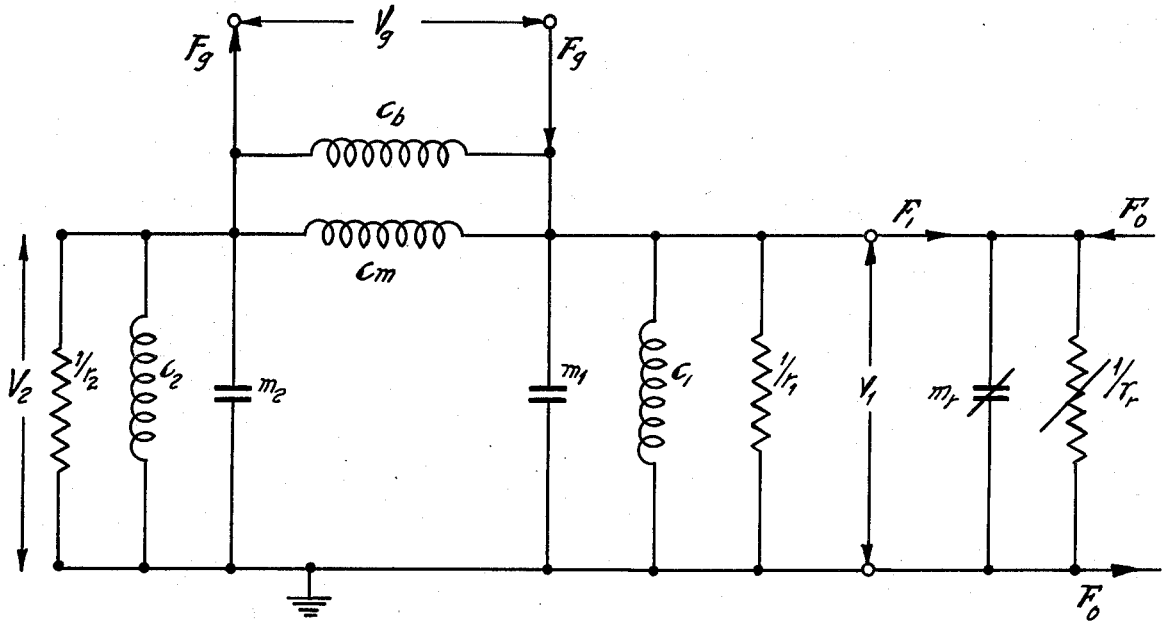
FIG. 13 is a mechanical equivalent circuit of the transducer described.
Figure 14:
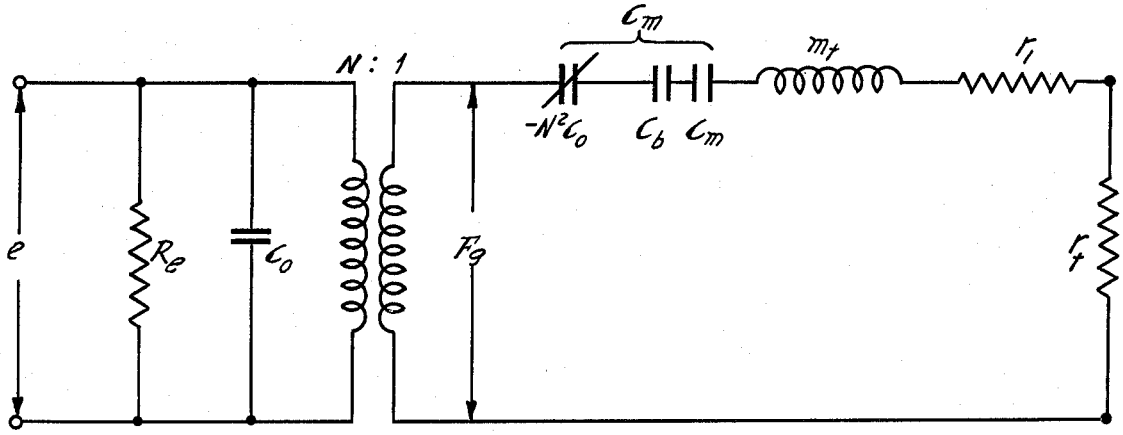
FIG. 14 is an electromechanical equivalent circuit as a projector for free-field loading in water, allowing for both electrical and mechanical losses.

The material of the front mass should have a high ratio of sound velocity to density to ensure that the frequencies of flexural resonance is well above the resonant frequency ($\omega r$). Titanium is advantageous because it provides comparatively high flexural stiffness for a given weight and face area; because the necessary flexural stiffness is obtainable with less weight than with other materials (e.g., steel) a low enough $Q_m$ for the desired bandwidth is readily obtainable.

Where dimensions in the direction of motion of the ceramic cylinder, the end masses, and the stacks of paper are short in terms of wavelength, lumped circuit treatment suffices for design and analysis. FIG. 13 shows the mechanical equivalent circuit of the described transducer, the basic elements including front mass $m_1$, rear mass $m_2$, and the compliance $c_m$ of the ceramic, and with the acoustic free-field loading resistors $r_r$ and the radiation mass $m_r$. The compliance of the mechanical bias rod is shown as $c_b$. Subscripts 1 and 2 refer to the front and rear, respectively; $c_1$ and $c_2$ are the compliances of the front and rear paper stacks. The manner in which compliances, $c_1$ and $c_2$ are shown as grounded in the circuit is justified for all practical purposes. The mechanical resistances, $r_1$ and $r_2$ account for internal mechanical losses. Fg is the alternating force generated by the piezoelectric cylinder, and $F_o$ is the steady hydrostatic force exerted on the front face of the transducer. The electromechanical equivalent circuit of the transducer as a projector for free field loading in water, allowing for both electrical and mechanical losses, is given in FIG. 14. These equivalent circuits are for the condition of radiation loading seen by a single element alone in the field. When driven as part of an array, the radiation mass of the average element has been found to be slightly lower, with the result that the frequency of the average element will be slightly higher. The mechanical Q, as well as the resonant frequency, of individual elements will vary somewhat, depending on position in the array.

The compliance of the paper stacks becomes less, very gradually, with increase in pressure. This tends to increase the shunting effect of $c_1$ and $c_2$ on $m_1$ and $m_2$ (FIG. 13) and a result is a slight increase in resonant frequency. For purposes of illustrating order of magnitude, in a transducer designed for resonance at 3.5 kilocycles per second, a pressure increase from 0–600 pounds per square inch produced an increase in resonant frequency of 250 cycles per second. This change in resonant frequency is controllable to a large extent by dimensioning the thickness of the two paper stacks in such manner that the rear stack $c_2$ alone takes the static pressure load up to a preselected level, say 600 pounds per square inch, and then above that pressure, the front stack $c_1$ takes most of the static pressure; this expedient also prevents damage to the ceramic element. The shunting effect of $c_2$ on $m_2$ is less than that of $c_1$ on $m_1$ as $m_2$ is substantially greater than $m_1$ and $c_2$ is substantially more compliant than $c_1$.

Obviously many modifications and variations of the present invention are possible in the light of the above teachings. It is therefore to be understood that within the scope of the appended claims the invention may be practiced otherwise than as specifically described.

We claim:

1. An improved underwater transducer comprising a piston of titanium having a planar active face for transfer of sonic wave energy between said piston and the water to which it is exposed, a housing having an opening whose perimeter is slightly larger all around than the perimeter of the piston, said piston being disposed across said opening, and nearly closing said opening with its active face directed outwardly, an elastomeric sealing material bonded to the perimeter of the piston and the perimeter of the housing around the opening and together with the piston completely closing the opening in the housing and with the active face of the piston exposed for contact with sea water, said elastomeric material permitting vibratory reciprocation of said piston relative to said housing and normal to its planar face for transfer of sonic energy between the piston and the water to which it is exposed, an electromechanical energy conversion means supported in the housing and coupled to the piston, said means together with said piston comprise a double mass elastic system and includes an electromechanical transducer element to which is securely and rigidly affixed said piston and another mass with the transducer element therebetween with the piston, the other mass and the transducer element in line and oriented longitudinally of the housing, and an acoustic isolator pressure release material in the form of a stack of paper disposed between the inner end of said other mass and the housing in the direction of relative longitudinal movement therebetween.

2. An improved transducer as defined in claim 1 wherein said electromechanical transducer element is an electrostrictive ceramic cylinder polarized radially for operation under high static endwise pressure without depolarization.

3. An improved underwater transducer for use in combination with a plurality of like transducers for forming an improved compact transducer array with increased active face area and reduced inactive area between transducers in the array and with the transducers acoustically isolated from each other, comprising a tubular housing terminating at one end in an enlarged rectangular coaxial portion having an opening directed axially of the housing and almost as large as said rectangular portion, a piston having a planar face and having a rectangular perimeter similar to that of said opening and slightly smaller all around than the perimeter of the opening, disposed across and recessed in said opening with its planar face directed outwardly of the housing and normal to the axis of the housing for reciprocal vibratory movement in the opening axially of the housing, elastomeric material disposed between and engaging the perimeter of the piston and the perimeter of the housing around the opening and together with the piston sealing said opening and supporting said piston for vibratory reciprocation relative to said housing and normal to its planar face, a rigid mass substantially heavier than the piston and having a perimeter slightly smaller all around than the inside wall of the housing disposed in the housing coaxial with but spaced from said piston, further elastomeric material between the perimeter of said mass and the housing wall, electromechanical energy conversion means disposed in said housing spaced from the housing wall and located between said piston and said mass and rigidly affixed and secured to said piston and said mass and with an air space between said means and the housing wall for acoustic isolation and a stack of fibrous, laminar, paper-like material, between the inwardly directed end of said mass and said housing for acoustic pressure release under static pressures corresponding to a wide range of seawater depth extending downward from just below the surface of the sea.

4. An improved underwater transducer as defined in in claim 3 wherein said electromechanical energy conversion means is an electrostrictive ceramic cylinder polarized radially for operation under static endwise pressure without depolarization and said mass is substantially cylindrical.

5. An improved underwater transducer as defined in claim 3 further including a second stack of fibrous laminar paper-like material between an inwardly directed portion of said piston and said housing and dimensioned relative to the first recited stack that it is not subjected to an increase in pressure until the first recited stack is subjected to a predetermined pressure corresponding to a preselected depth in sea water.

6. A transducer operable at high efficiency at high power density, over wide pressure and temperature ranges, which comprises an electroacoustic element that converts vibratory energy into electrical energy and vice versa, a relatively heavy inertia mass and a relatively light propagating and receiving mass abutting and confined to opposite sides of said element in axial alignment with one another, means for supporting said inertia mass and having, in abutment with that face of said inertia mass remote from said element, to oppose movement of said inertia mass in a direction away from said propagating and receiving mass, a stack of fibrous, laminar, paper-like material that has low loss of absorbed energy, for minimizing transfer of vibrant energy from said inertia mass to said supporting means, and a stack of annular rings of sheet fibrous material disposed around said light mass, confined between and having its opposite faces, abutting opposing facing areas of said light mass and said supporting means, respectively.

7. An improved underwater transducer comprising electromechanical energy conversion and acoustic radiating means operable in a longitudinal mode, a housing for said means, an elastic mounting encircling said means normal to its longitudinal mode and securing said means to said housing, said housing and said means and said resilient mounting confining a water-tight volume containing at least a portion of said means, said elastic mounting being elastically yieldable under increased hydrostatic pressure to permit said means to be displaced inwardly of said housing in the direction of its longitudinal mode, and a stack of fibrous laminar paper-like material disposed between said means and said housing and compressed therebetween under elevated hydrostatic pressure for efficient acoustic pressure release within a substantial range of hydrostatic pressure, the laminae being oriented normal to the longitudinal mode.

8. A transducer operable at high efficiency at high power density, over wide pressure and temperature ranges which comprises a housing having therein a chamber with one chamber end opening outwardly at one wall of the housing and otherwise closed and impervious to water, a transducer unit of the type having a hollow cylinder of electrostrictive material having on each of its inner and outer cylindrical surfaces substantially continuous electroded surfaces and polarized radially, and a separate loading mass bonded to each end of said cylinder and aligned with each other and the cylinder, one of said masses being substantially lighter than the other, said unit being disposed endwise in said chamber with said lighter mass extending outwardly through said one chamber end and terminating in a flexurally stiff, exposed planar face normal to said aligned masses and cylinder, said lighter mass being of a material with a high ratio of sound velocity to density, elastomeric means between and bonded to said chamber wall and lighter mass sealing the space between them against passage of water into said chamber and guiding said lighter mass in vibratory movements in directions into and out of said chamber, means for establishing circuit connections between the exterior of said chamber and said electroded surfaces, and a stack of paper-thin sheets of fibrous cellulose paper-like material disposed in said chamber in a position opposing and resisting movement of said heavier mass toward the inner end of said chamber under static pressure applied against said planar face.

9. A transducer operable at high efficiency at high power density, over wide pressure and temperature ranges which comprises a housing having a chamber having one end opening outwardly at one wall of the housing and otherwise closed and impervious to water, a stack of paper-thin sheets of fibrous cellulose material disposed in said chamber with one end face thereof abutting face to face against the wall at that end of said chamber opposite from said open end, a relatively heavy inertia mass disposed in said chamber, with said stack between a portion of this inertia mass and a part of said housing and resisting movement of said mass toward the inner end of said chamber, an electroacoustic element that converts vibratory energy into electrical energy and vice versa disposed in said chamber and abutting said inertia mass, a relatively light weight energy propagating and receiving mass disposed in said chamber, abutting and confined to said element and having an end portion extending outwardly of said chamber through said open end and there terminating in a planar, exposed, rigid energy propagating and receiving face, and elastomeric means between and bonded to said light weight mass and housing for sealing the space between them against penetration of water between them into said chamber and guiding said light mass in limited vibratory movements in directions into and out of said chamber.

10. An improved underwater transducer comprising a piston of titanium having a planar active face for transfer of sonic wave energy between said piston and the water to which it is exposed, a housing having an opening whose perimeter is slightly larger all around than the perimeter of the piston, said piston being disposed across said opening, and nearly closing said opening with its active face directed outwardly, an elastomeric sealing material bonded to the perimeter of the piston and the perimeter of the housing around the opening and together with the piston completely closing the opening in the housing and with the active face of the piston exposed for contact with sea water, said elastomeric material permitting vibratory reciprocation of said piston relative to said housing and normal to its planar face for transfer of sonic energy between the piston and the water to which it is exposed, electromechanical energy conversion means supported in the housing and coupled to the piston, and an acoustic isolator pressure release material in the form of a stack of paper disposed between the piston and the housing in the direction of relative movement therebetween.

* * * * *